US009057220B2

(12) United States Patent
Carlson et al.

(10) Patent No.: US 9,057,220 B2
(45) **Date of Patent: *Jun. 16, 2015**

(54) PLASTIC WINDOW FRAME TRIM FOR CORRUGATED BUILDING WALLS AND INSTALLATION METHOD

(71) Applicant: A.J. Manufacturing Inc., Bloomer, WI (US)

(72) Inventors: Todd C. Carlson, Eau Claire, WI (US); Timothy J. Rogge, Eau Claire, WI (US)

(73) Assignee: A.J. Manufacturing Inc., Bloomer, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/329,282

(22) Filed: Jul. 11, 2014

(65) Prior Publication Data

US 2014/0318051 A1 Oct. 30, 2014

Related U.S. Application Data

(63) Continuation of application No. 13/166,374, filed on Jun. 22, 2011, now Pat. No. 8,776,461, which is a continuation-in-part of application No. 12/914,569, filed on Oct. 28, 2010, now Pat. No. 8,776,460.

(51) Int. Cl.
*E06B 1/04* (2006.01)
*E06B 3/00* (2006.01)
(Continued)

(52) U.S. Cl.
CPC ..... *E06B 1/36* (2013.01); *E06B 3/4618* (2013.01); *E06B 2001/628* (2013.01); *E06B 1/56* (2013.01); *E06B 3/20* (2013.01); *E06B 7/14* (2013.01)

(58) Field of Classification Search
CPC ..... E06B 1/62; E06B 3/302; E06B 1/702; E06B 1/705; E06B 2001/622; E06B 1/34; E06B 2001/628; E06B 1/30; E06B 1/36; E06B 3/4618; E06B 1/56; E04F 19/02; E04F 13/0864; E04F 19/06; E04F 13/06; Y10S 49/02
USPC ..... 52/204.5, 204.55, 204.71, 204.72, 208, 52/211, 800.11, 800.12, 800.17, 800.18, 52/802.11, 717.01, 717.06, 718.01, 474, 52/475.1, 60, 62
See application file for complete search history.

(56) References Cited

U.S. PATENT DOCUMENTS 2,771,970 A 11/1956 Geyser
2,918,706 A 12/1959 Rust et al.

(Continued)

OTHER PUBLICATIONS

Hayfield Window and Door Company, Drawing specifications for window with attached trim system, Oct. 11, 1990.

(Continued)

*Primary Examiner* — Brian Glessner
*Assistant Examiner* — Omar Hijaz
(74) *Attorney, Agent, or Firm* — Gerald E. Helget; Nelson R. Capes; Briggs and Morgan, P.A.

(57) ABSTRACT

A plastic window frame trim is for installation of a window in a corrugated metal building wall having a cut opening with a top edge, bottom edge, and side edges, each of the edges being backed by framing members. The window frame trim includes: a frame header J-channel with a flange; a frame footer J-channel with a flange; a pair of nailing fins; and fasteners. The trim header J-channel, footer J-channel, and nailing fins are attached to the window frame. The window frame is lifted so frame header J-channel flange slides between the top edge of the metal building wall and a framing member at the top of the cut opening. The window is lowered so footer J-channel flange slides between the bottom edge of the metal building wall and a framing member at the bottom of the cut opening so that window frame rest on the window sill. Fasteners attach the window frame to the framing members through the metal building wall. Trim caps snap over the nailing fins to finish the trimmed window.

11 Claims, 14 Drawing Sheets

(51) Int. Cl.

| | |
|---|---|
| ***E06B 3/988*** | (2006.01) |
| ***E04D 1/36*** | (2006.01) |
| ***E04C 2/38*** | (2006.01) |
| ***E06B 1/36*** | (2006.01) |
| ***E06B 3/46*** | (2006.01) |
| ***E06B 1/56*** | (2006.01) |
| ***E06B 3/20*** | (2006.01) |
| ***E06B 7/14*** | (2006.01) |
| *E06B 1/62* | (2006.01) |

(56) References Cited

U.S. PATENT DOCUMENTS

| | | | |
|---|---|---|---|
| 3,583,114 | A | 6/1971 | Belfor |
| 3,815,285 | A | 6/1974 | Kuyper |
| 4,280,309 | A | 7/1981 | Huelsekopf |
| 4,281,481 | A | 8/1981 | Wendt |
| 4,299,060 | A | 11/1981 | Tippmann |
| 4,563,846 | A | 1/1986 | Webb |
| 4,608,800 | A | 9/1986 | Fredette |
| 4,694,612 | A | 9/1987 | Pruden et al. |
| 5,018,325 | A | 5/1991 | Green et al. |
| 5,343,668 | A | 9/1994 | Gonzalez |
| 5,392,574 | A | 2/1995 | Sayers |
| 5,551,196 | A | 9/1996 | Paredes et al. |
| 5,660,010 | A | 8/1997 | Sayers |
| 5,924,259 | A | 7/1999 | Marousek |
| 5,966,880 | A | 10/1999 | Bridges et al. |
| 6,631,595 | B1 | 10/2003 | Minter |
| RE40,041 | E | 2/2008 | Sayers |
| 2005/0034388 | A1 | 2/2005 | Bealko |
| 2005/0183379 | A1 | 8/2005 | Sweeney et al. |
| 2007/0277455 | A1 | 12/2007 | Flanigan et al. |
| 2009/0044466 | A1 | 2/2009 | Andres |
| 2009/0266014 | A1 | 10/2009 | Green |

OTHER PUBLICATIONS

Eastco Aluminum, Morton Panning Jamb window specifications, Aug. 12, 1983.

Eastco Aluminum, Morton Panning Jamb window specifications, Jun. 4, 1983.

Eastco Aluminum, Morton Panning Jamb window specifications, Jan. 30, 1984.

AJ Manufacturing, Inc., "Let the Light In: Using AJ Manufacturing's Utility Windows" (EZ Fit Product Sheets), Jun. 30, 1983.

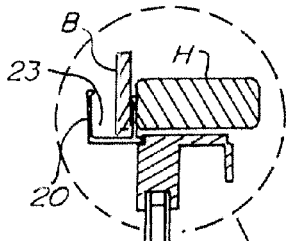
(Fig.19)
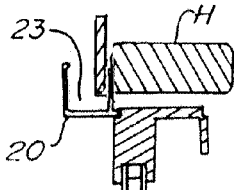
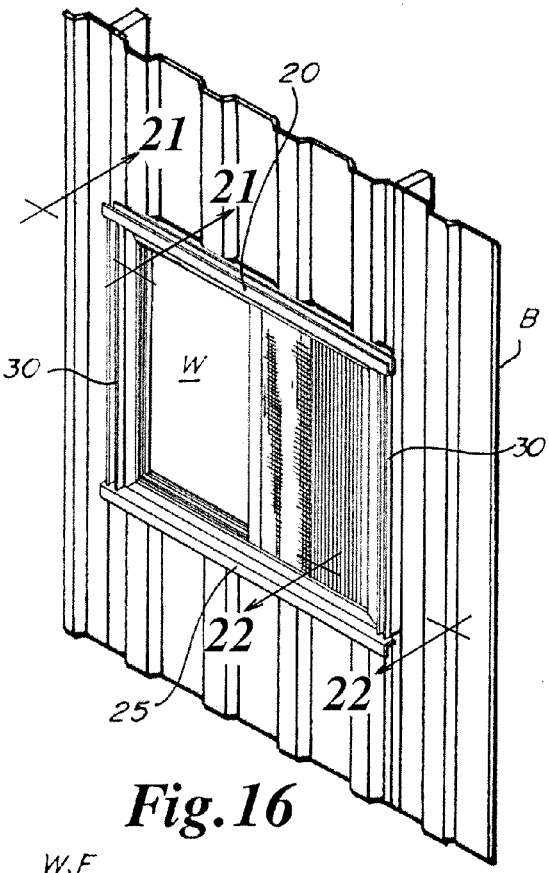
Fig.16
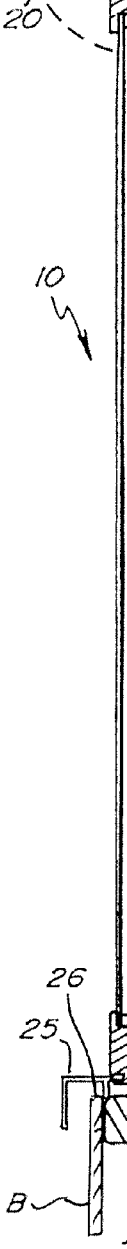
Fig.14
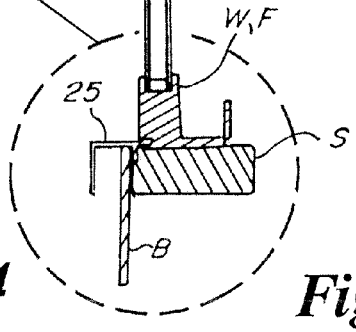
Fig.15
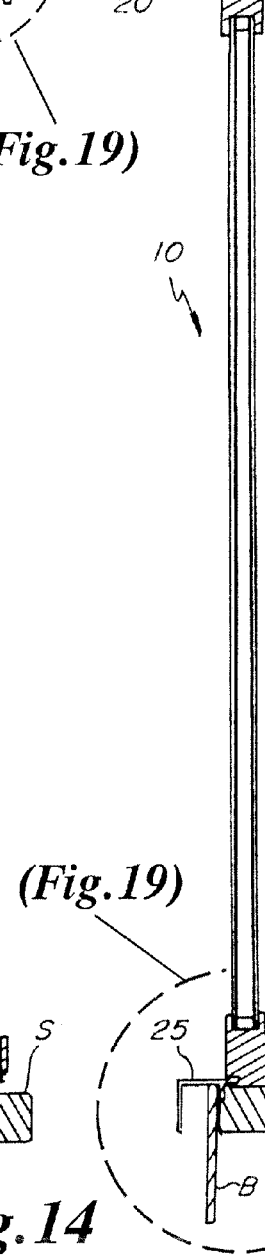

PLASTIC WINDOW FRAME TRIM FOR CORRUGATED BUILDING WALLS AND INSTALLATION METHOD

CROSS-REFERENCE TO RELATED APPLICATION

The present application is a continuation application of U.S. Utility patent application Ser. No. 13/166,374, filed Jun. 22, 2011, which is a continuation-in-part of U.S. Utility patent application Ser. No. 12/914,569 filed Oct. 28, 2010.

BACKGROUND OF THE INVENTION

The present invention relates to a vinyl or other plastic frame that can be attached to a standard residential vinyl window to permit the window to be inserted into the corrugated wall of a structure such as a steel clad post frame building, with a fully trimmed window frame that will accommodate the raised ribs of the building skin.

Buildings constructed of corrugated steel sheet panels have been used in order to reduce the cost of industrial-type or residential-type buildings. A corrugated metal building can be constructed by forming corrugated sheet into load carrying, spaced apart upright walls.

However, when it is necessary to form a window opening in the corrugated wall of such a building, it would be advantageous to use pre-hung, standard residential windows of the horizontal slider, single hung, double hung, or other type. Such standard windows are typically installed in non-corrugated walls by framing an opening in the wall with wood or metal members, such as studs, headers and sill cross members and then nailing or otherwise fastening the window to the framing studs. Because of the corrugated walls, a standard residential window will not fit flush with the exterior building wall and the corrugated walls do not permit the use of standard moldings. Therefore an external frame is desirable to cover the rough-cut opening. Also, the metal wall will expand and contract and the frame must permit this.

There is therefore a need for an easily-attachable frame for a residential window that will permit the window to be installed in a cut opening in the corrugated building wall and cover the unsightly components of the standard window frame. The frame must also tightly seal the window against water penetration.

The frame must be paintable; must be fully trimmed; should dramatically reduce installation labor; be tolerant of thermal expansion and contraction; and divert all water to the building exterior.

SUMMARY OF THE INVENTION

The present invention is a vinyl or other plastic frame trim for a typical residential vinyl window. In the preferred embodiment, the invention consists of various PVC extrusions functioning as J-channel header and sill, vertical nail fins, and vertical trim caps to adapt to the accessory groove of a particular window master frame.

The vertical nailing fins and horizontal J-channels are snapped into the accessory groove of the window master frame at the factory. Screws are applied to secure the J-channels to the nailing fins at the factory, and the window can be shipped with the vertical trim caps to be applied later. Alternatively, the J-channel and nailing fins can be applied to the window conventionally with screws, glue or welding.

The window is installed with the back fin or vertical flange of the J-channels just behind the building skin, and the nailing fins on the outer surface of the building skin, with screws through the nailing fins to secure the window to the structure. Trim caps are then applied over the nailing fins to conceal all installation fasteners.

A principle object and advantage of the present invention is that it can easily be attached to a standard window frame with or without an accessory groove.

Another principle object and advantage of the present invention is that it is easily adaptable to various window designs.

Another principle object and advantage of the present invention is that it dramatically reduces installation labor and raw material costs.

Another object and advantage of the present invention is that it may be attached at the window factory or in the field.

Another object and advantage of the present invention is that it tolerates expansion and contraction of the corrugated metal building wall.

BRIEF DESCRIPTION OF DRAWINGS

FIGS. 14 and 15 are similar to FIGS. 10 and 12 and show completion of installation of the window into the cut-out opening in the building wall.

FIG. 16 is a perspective view showing the window with trim resting in the cut-out opening in the building wall.

DETAILED DESCRIPTION OF THE PREFERRED EMBODIMENT

Figure 1:
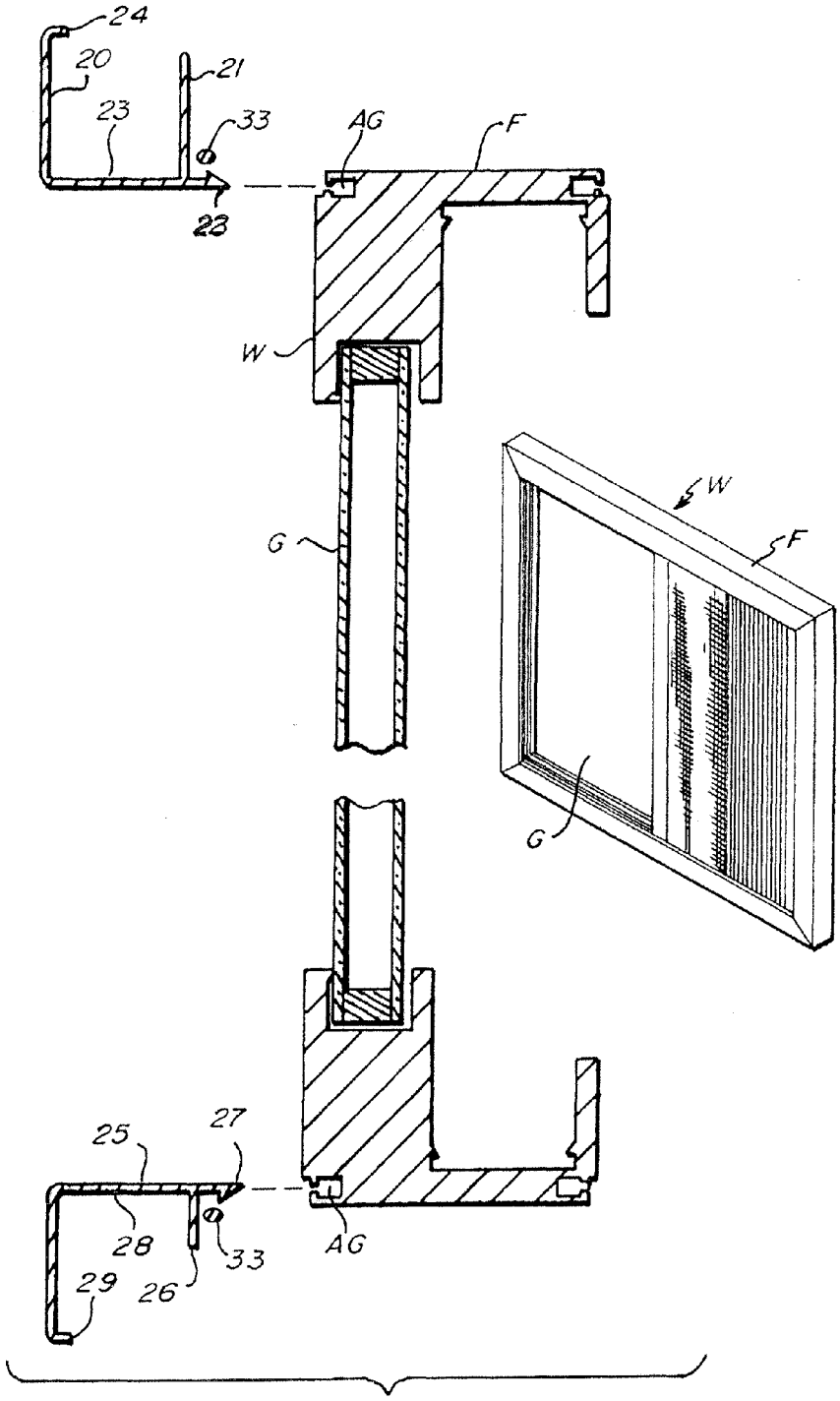
FIG. 1 is a vertical cross-section through a standard window W showing the attachment of the upper and lower J-channels of the present invention.

A typical residential vinyl or wood window is shown in FIG. 1 as reference W. The window W has the following parts (as a typical minimum): a frame F, into which is secured window glass sash G; and an optional accessory groove AG around the perimeter of the frame F. Depending on the window type, other components such as sliders, screens, etc. may be present but are not required for the present invention.

Figure 2:
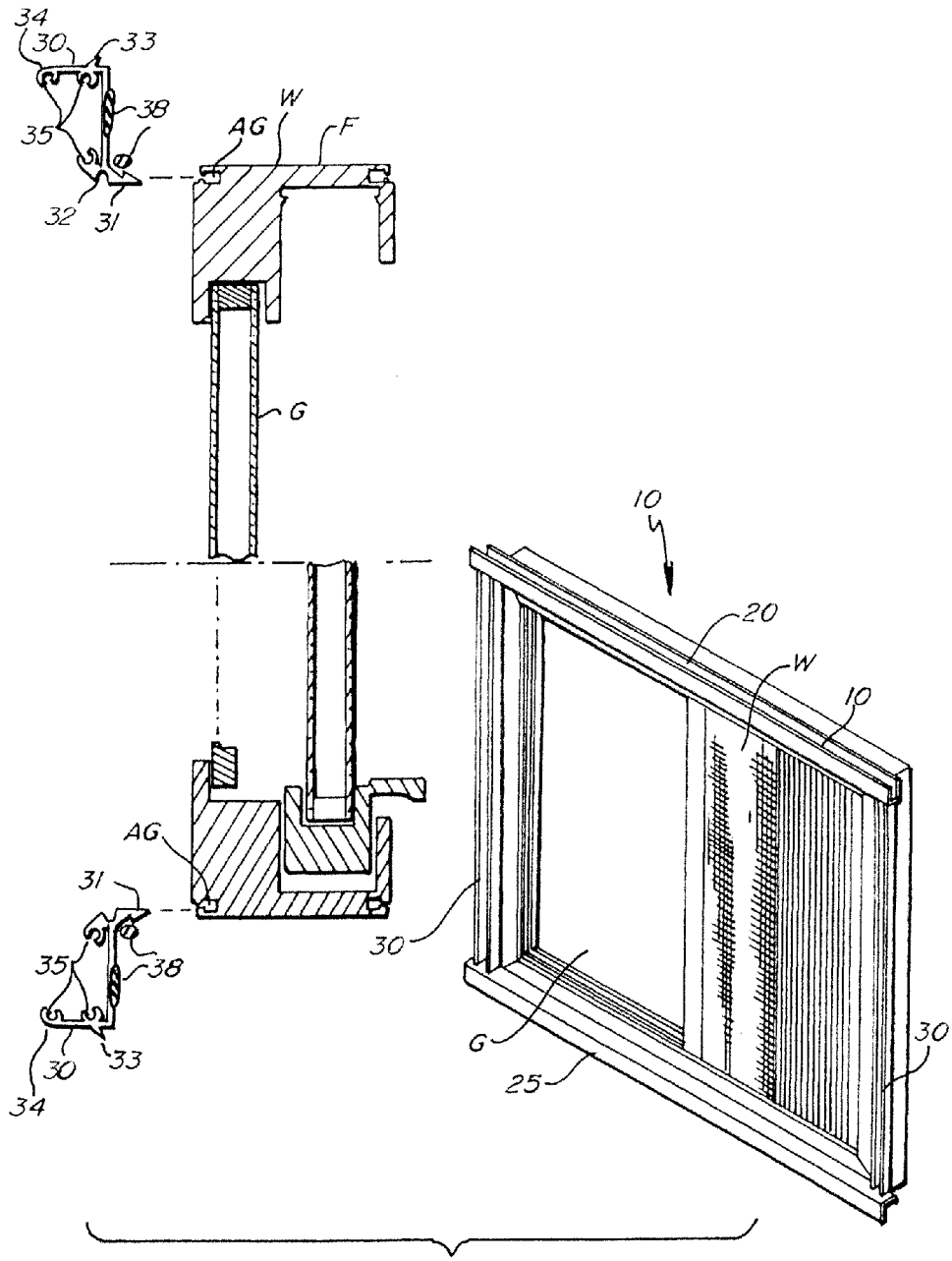
FIG. 2 is a horizontal cross-section through the window of FIG. 1 showing the attachment of the vertical nailing fins of the present invention.
Figure 3:
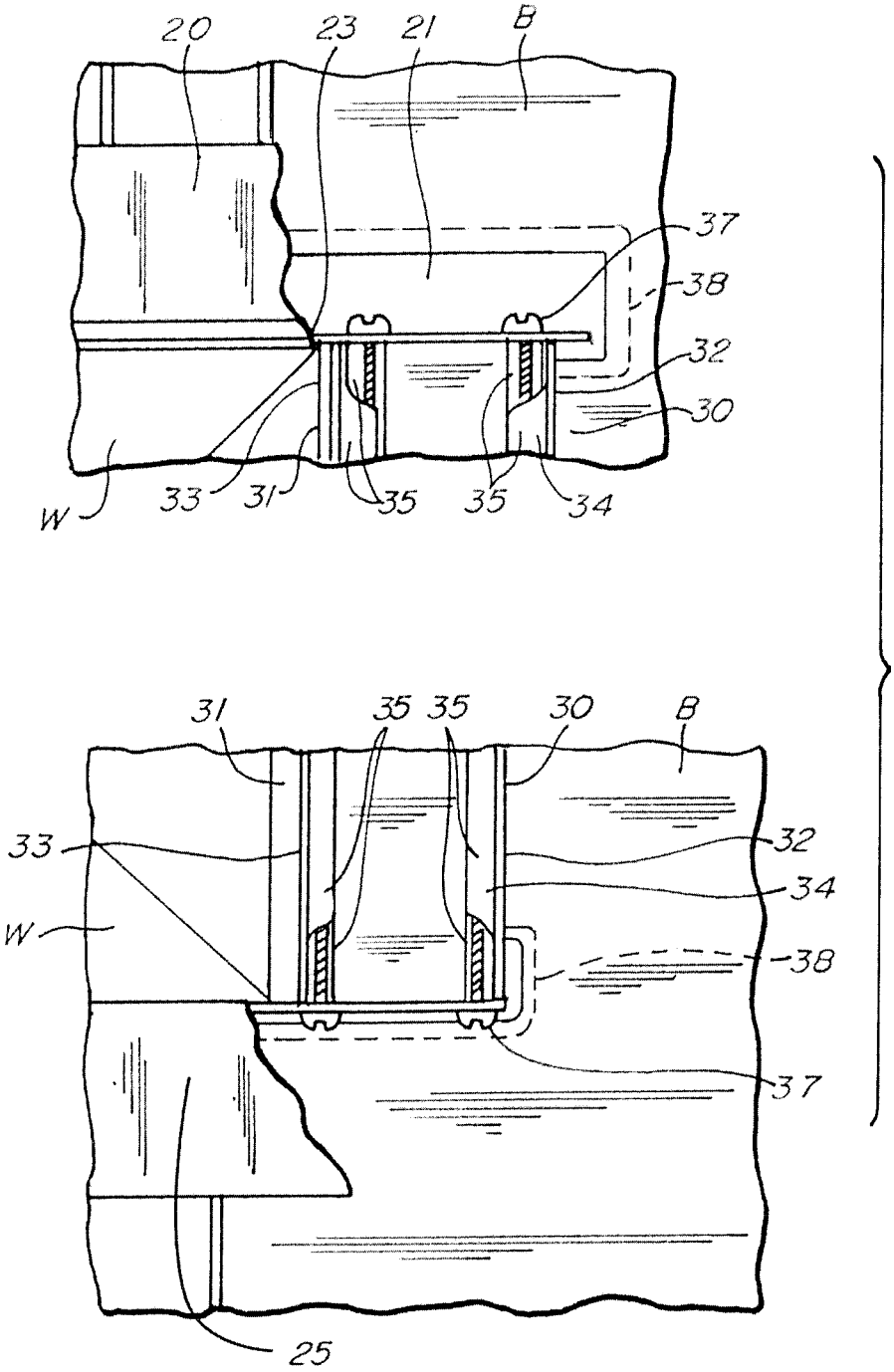
FIG. 3 is a front elevational view broken away of right vertical nailing fin.
Figure 5:
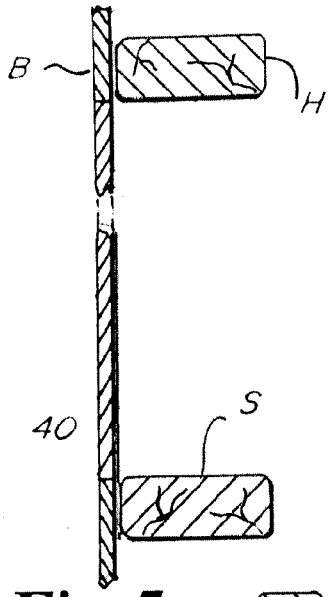
FIG. 5 is a vertical cross sectional view taken along lines 5-5 of FIG. 4.
Figure 6:
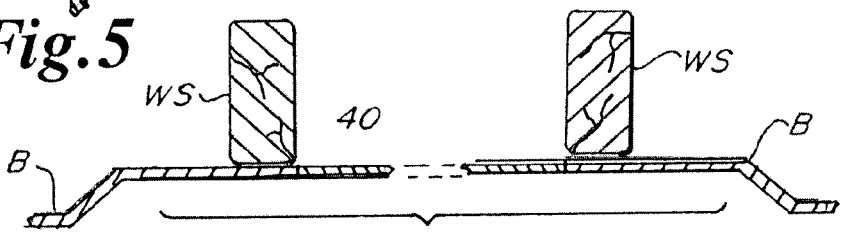
FIG. 6 is a horizontal cross sectional view taken along lines 6-7 of FIG. 4.
Figure 4:
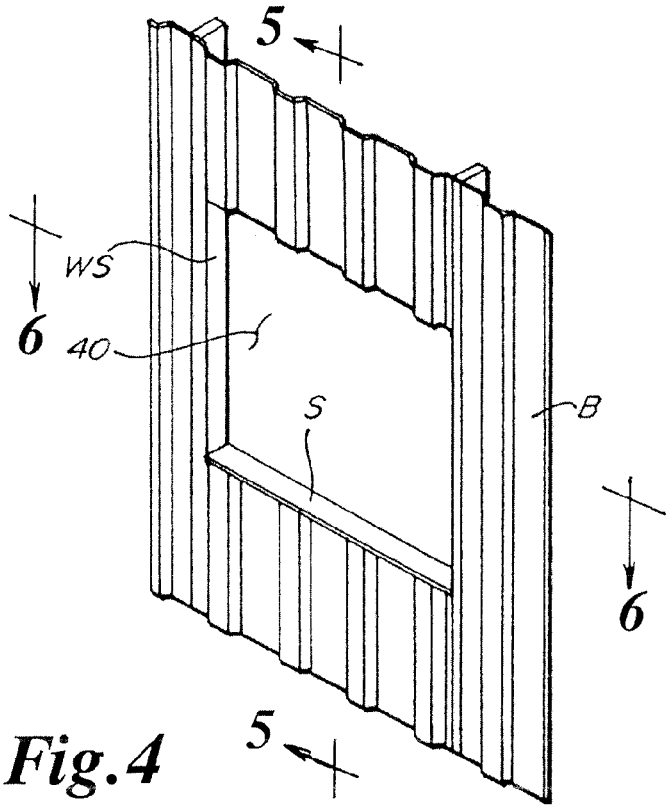
FIG. 4 is a perspective view of a building wall section with window opening exposed the window-building framework.
Figure 7:
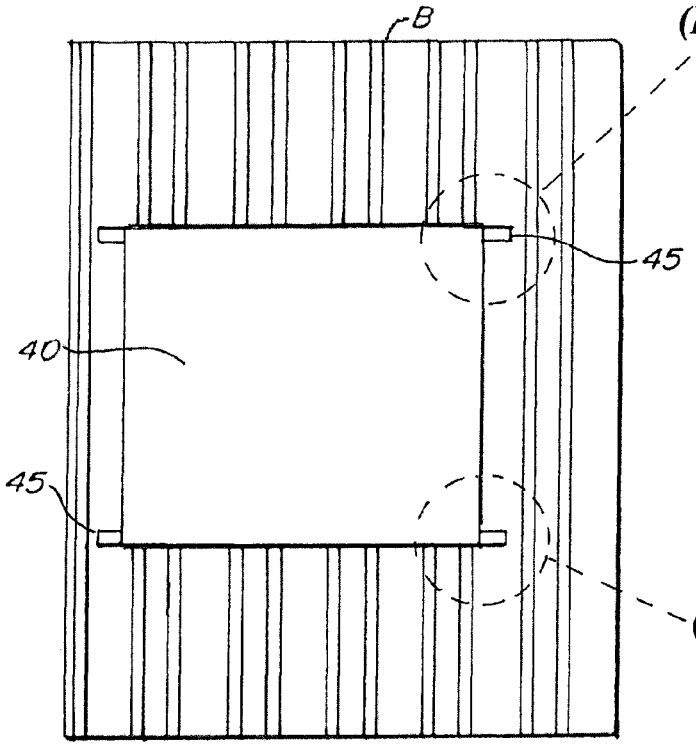
FIG. 7 is a front elevational view of the building wall section with window opening exposed showing horizontal window cut extensions.
Figure 8:
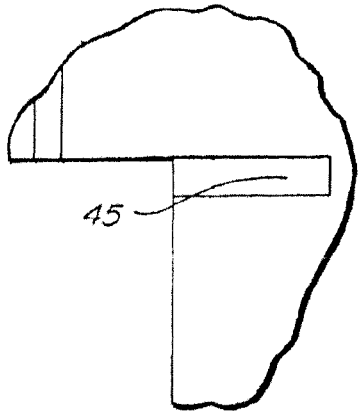
FIG. 8 is an enlarged view of one of the top horizontal window cut extensions of FIG. 7.
Figure 9:
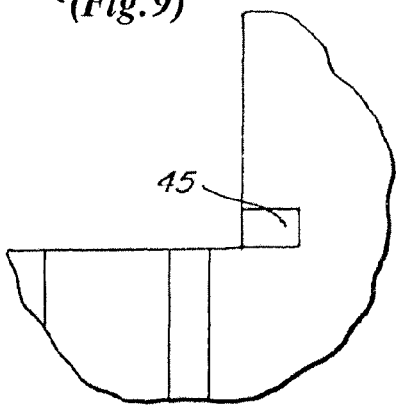
FIG. 9 is an enlarged view of one of the bottom horizontal window cut extensions of FIG. 7.
Figure 10:
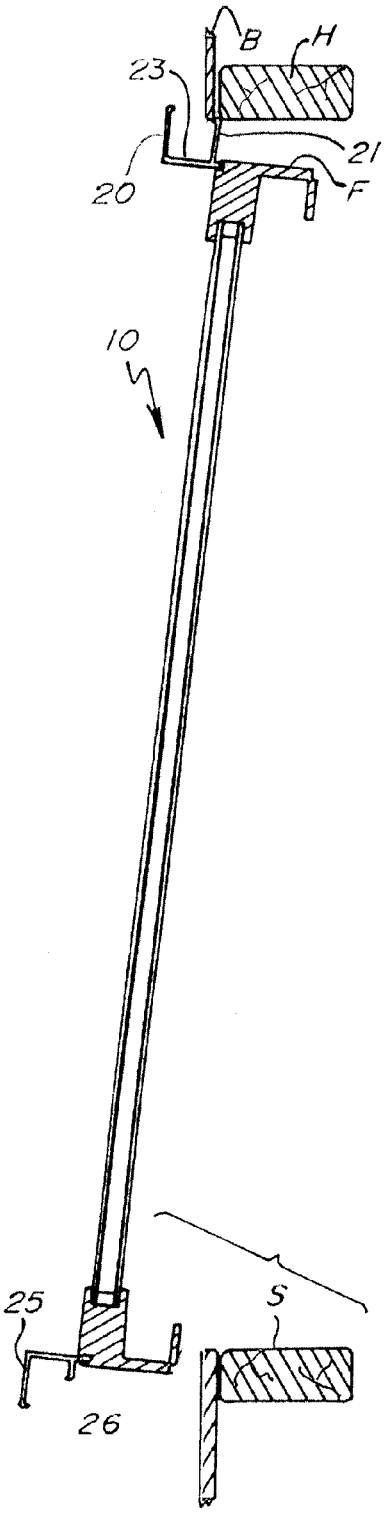
FIG. 10 is a vertical cross-sections through the window and exterior plastic window trim showing installation of the window into the cut-out opening in the building wall.

The present invention (see FIGS. 1, 2 and 3) comprises a plastic or aluminum exterior window trim 10, which in turn comprises: a frame header J-channel 20; a frame footer or sill J-channel 25; and vertical nailing fins 30. The frame J-channels 20, 25 have vertical flanges 21, 26, attachment barbs 22, 27, gutter channels 23, 28 and lips 24, 29.

The vertical nailing fins 30 have attachment barbs 32, trim cap detents 32, trim cap barbs or detents 33, trim cap outward extensions 34, screw channels 35, screw apertures 36 which may be crisscross for expansion allowance.

Figure 1A:
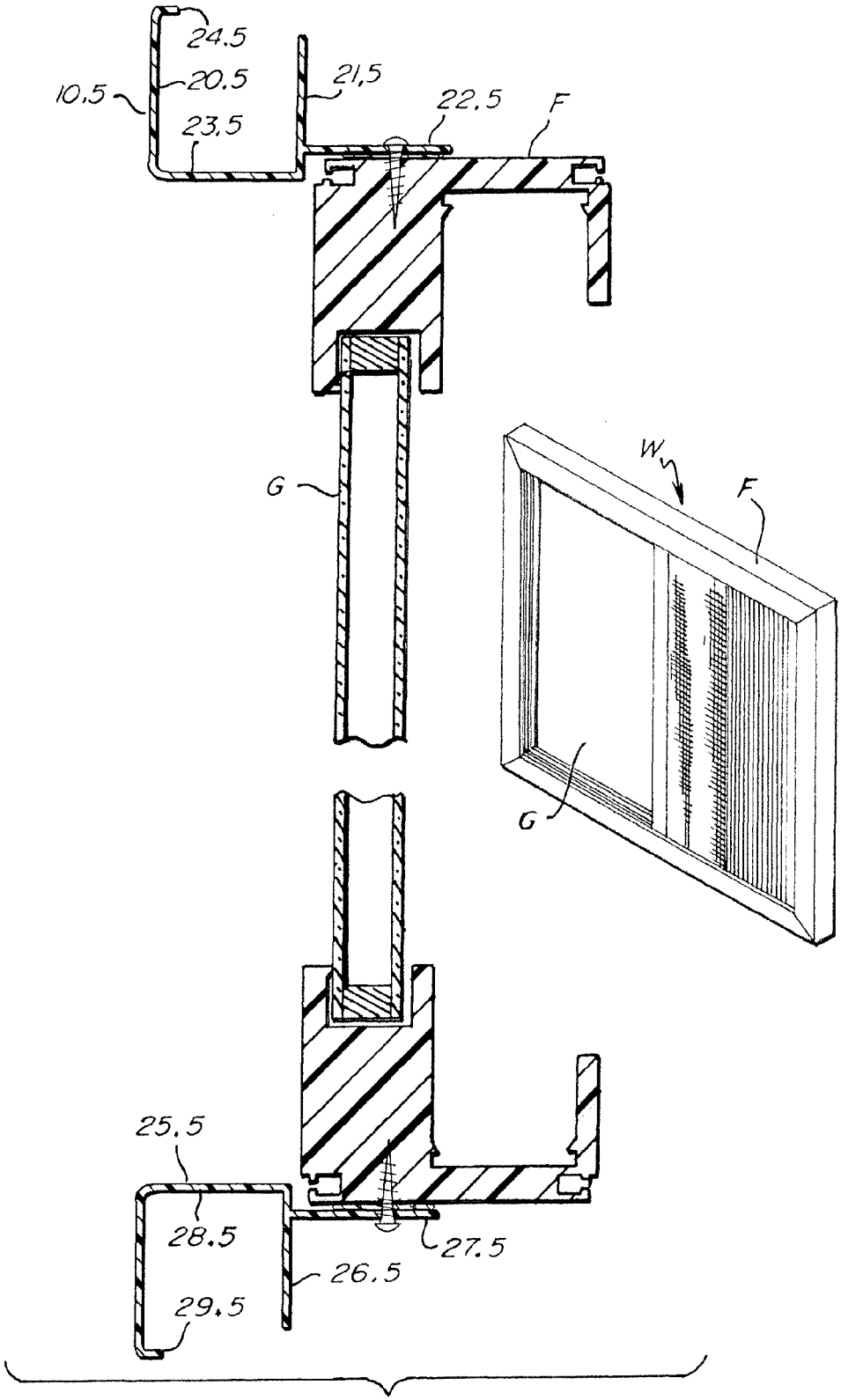
FIG. 1A is a vertical cross-section through a standard window W showing conventionally attached upper and lower J-channels of the present invention.
Figure 2A:
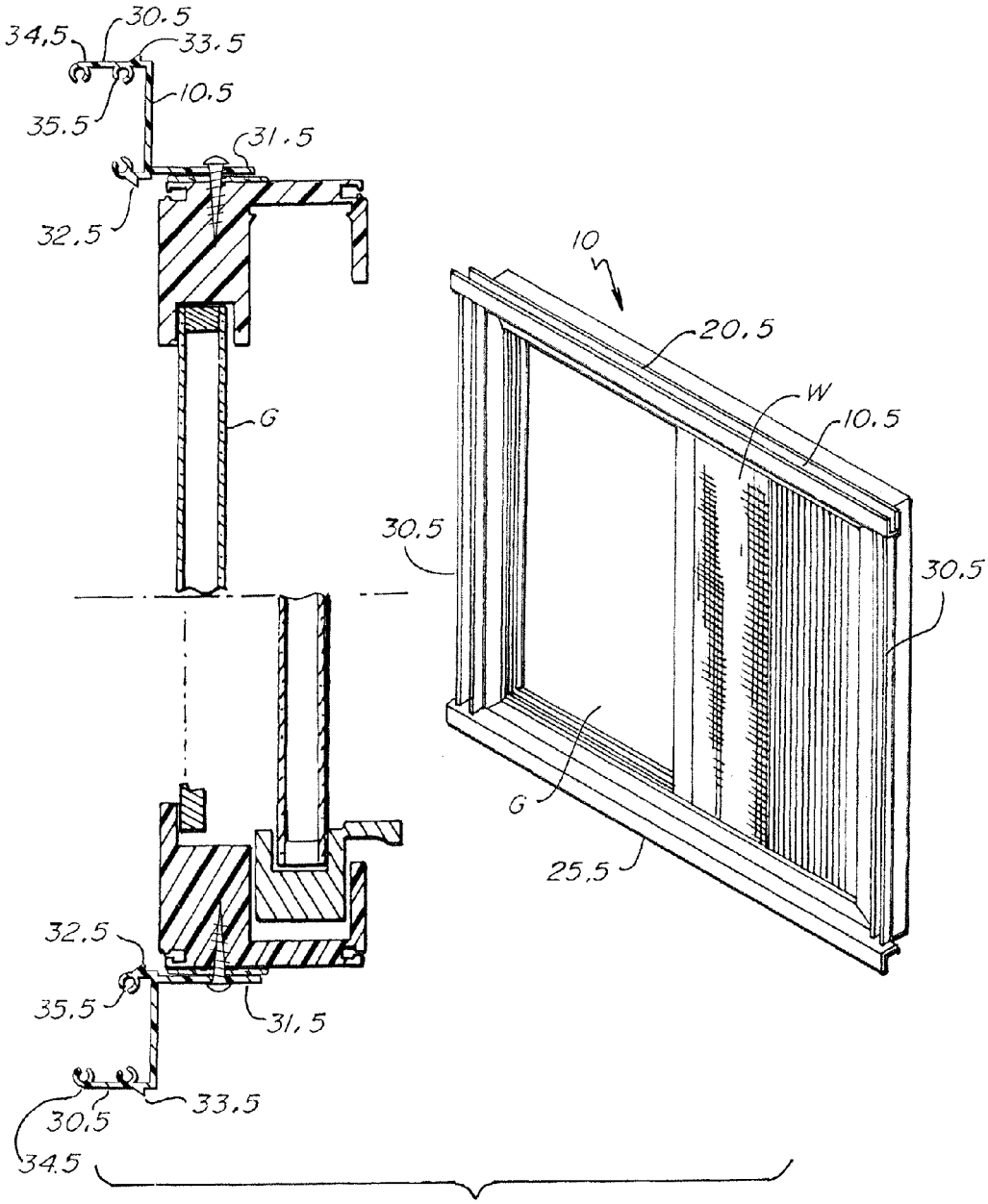
FIG. 2A is a horizontal cross-section through the window of FIG. 1A showing conventionally attached vertical nailing fins of the present invention.

The present invention in FIGS. 1A and 2A is an exterior window trim 10.5 which fastens to window W without use of an accessory groove AG. Trim 10.5 comprises a frame header J-channel 20.5, a frame footer or sill J-channel 25.5 as vertical nailing fins 21.5, 26.5, attachment flanges 22.5, 27.5, 31.5 instead of barbs 22, 27, 31, gutter channels 23.5, 28.5 and lips 24.5, 29.5. Flanges 22.5 and 27.5 are screwed, glued and/or welded to the top and bottom of frame F as shown. Flanges 31.5 are similarly screwed, glued and/or welded to the sides of frame F as shown.

At the building site, as shown in FIGS. 4-9, an opening 40, appropriate to the size of the window W, is then cut into the building skin B, and the opening 40 is framed on the inside of the building with wood framing members including adjacent vertical wood or metal studs WS, sill cross member S, and header cross member H. The horizontal window opening cuts in the window opening 40 are slightly extended 45 to receive extensions of the J-channels 20 and 25 as to overhang window opening 40 to decrease the chance of water entering the window opening 40 after complete installation which will be appreciated later.

Installation of the present invention into a residential window proceeds as follows.

First, the frame header J-channel 20 and frame footer J-channel 25 are attached to the accessory groove AG of the window W by pressing the attachment barbs 22, 27 into the accessory groove AG until they snap into place, as shown in FIG. 1. Sealant 38 may be applied to the J-channel along the attachment barbs 22, 27 adjacent the accessory grooves AG before the J-channels 20 and 25 are thus attached. Alternatively, flanges 22.5 and 27.5 are conventionally secured to window frame F.

Next, the vertical nailing fins 30 are attached to the accessory groove AG by pressing the attachment barbs 32 into the accessory groove AG until they snap into place, as shown in FIG. 2. Sealant 33 may be applied to the nailing fin attachment barbs 31 adjacent the accessory groove AG before the vertical nailing fins 30 are thus attached. Again, alternatively, flanges 31.5 are conventionally secured to window frame F.

Screws 37 are driven through the ends of the J-channels 20 and 25 at detents (not shown) into screw channels 35 formed in the extruded nailing fins 30.

As discussed, the above steps may be completed at the factory or in the field.

Figure 11:
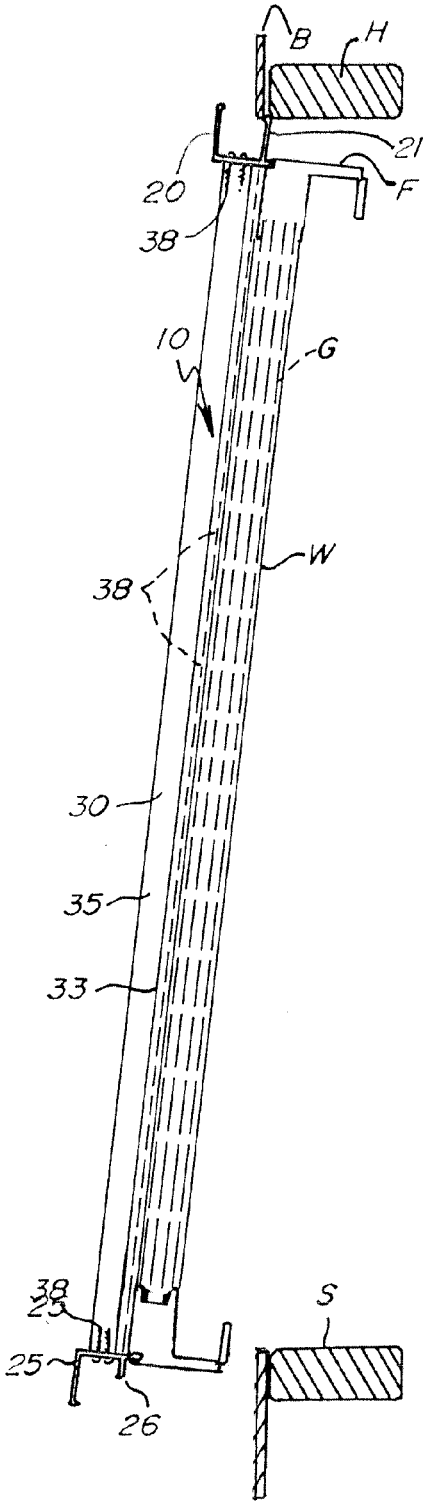
FIG. 11 is a vertical cross-sections through the window opening showing the window frame and exterior plastic window trim.

Before installation, a bead of sealant 38 is laid down on the back side of the nailing fins 30 as shown in FIG. 11. Next, shown in steps in FIGS. 10-15, the vertical flange 22 of the header J-channel 20 is slid up behind the building skin B so that the flange 22 is pressed between the building skin B and the upper framing member or header cross member H. This is done while the bottom of window frame F rests on the outside of the building skin B and sill S.

Figure 12:
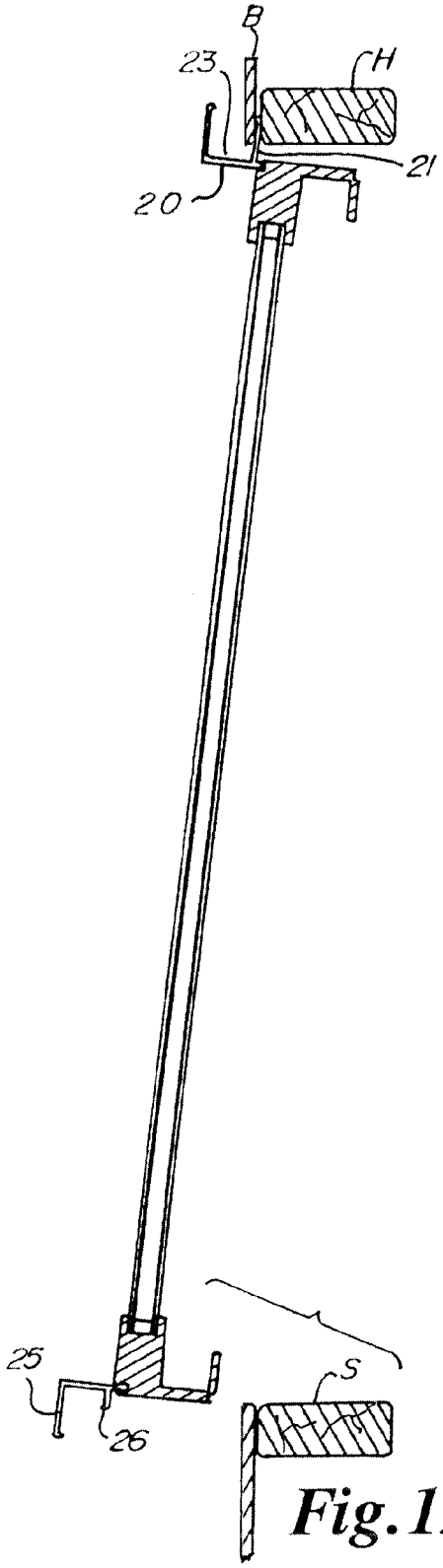
FIG. 12 is a vertical cross-sections through the window and exterior plastic window trim showing installation of the window into the cut-out opening in the building wall.
Figure 13:
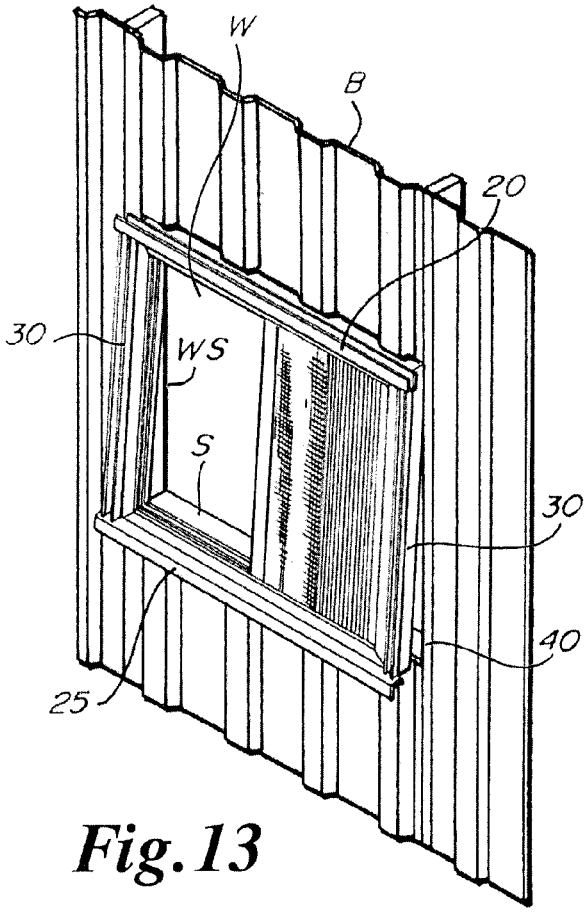
FIG. 13 is a perspective view showing installation of the window with trim into the cut-out opening in the building wall.

Next, the window W with trim 10 is lifted upwardly and as shown in FIGS. 12-14. The vertical flange 26 of the footer J-channel 25 is slid behind the building skin B so that the flange 22 is pressed between the building skin B and the lower framing member or sill cross member S. The window is then lowered downwardly until the gutter channel 28 of the footer J-channel 25 rests in contact with the building skin B and window frame F rests upon the sill cross member S shown in FIGS. 15-19.

Figure 17:
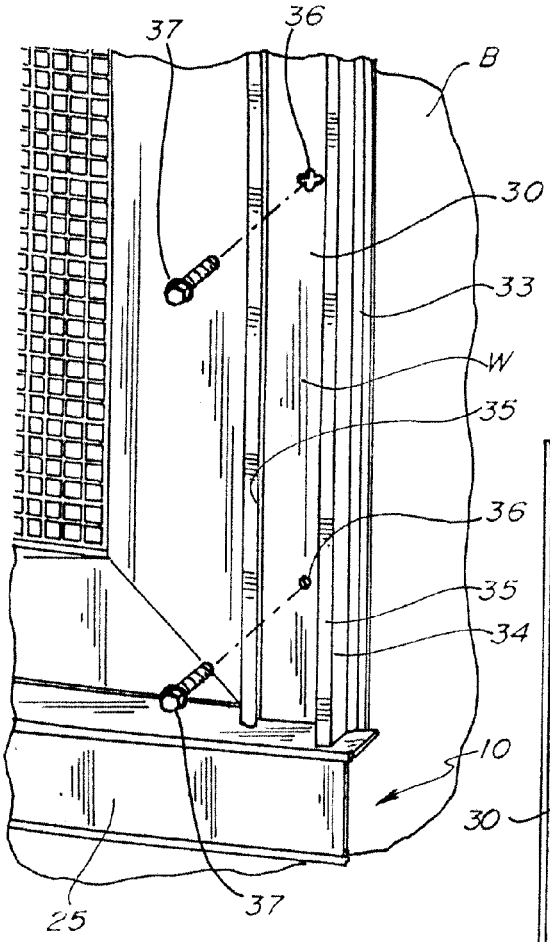
FIG. 17 is a partial perspective view of the window frame of the present invention showing fasteners being installed into the vertical nailing fins.
Figure 18:
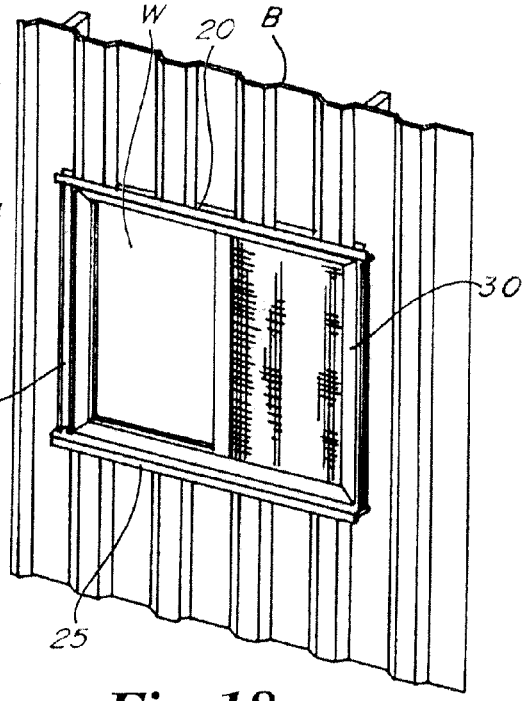
FIG. 18 is a perspective view of the window frame of the present invention after installation of the fasteners of FIG. 17.

Next, as shown in FIG. 17, fasteners or screws 37 are driven through screw apertures 36 in the vertical nailing fins 30, though the building skin B, and into the vertical framing member or studs WS. Preferably, one or more of the apertures 36 may be slotted to allow for both horizontal and vertical expansion of the window frame W and it rest on the sill cross member S.

Figure 19:
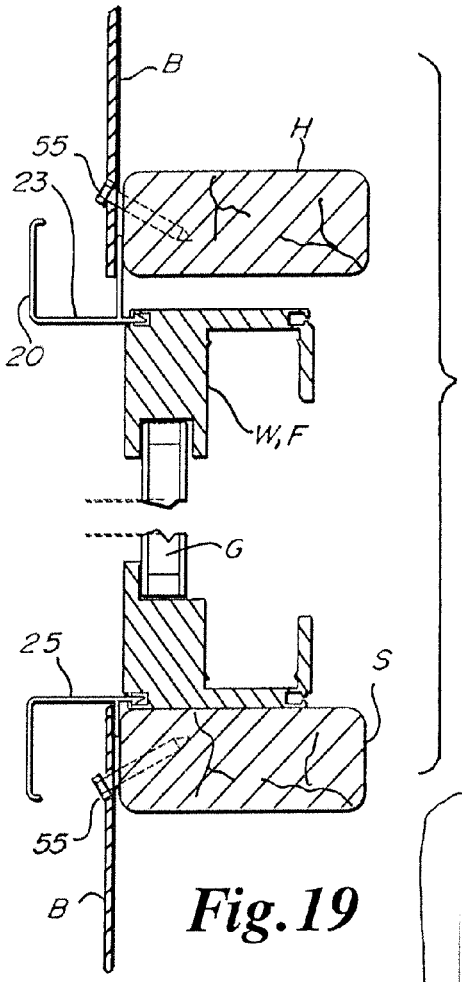
FIG. 19 is a horizontal cross-section of the window frame of the present invention secured to the building wall by fasteners.
Figure 20:
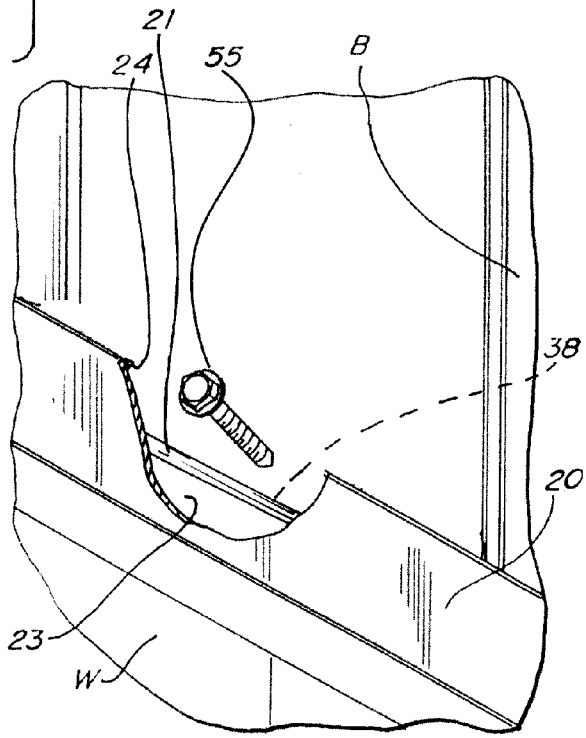
FIG. 20 shows the installation of the fasteners of FIG. 19.

FIGS. 19-20 shows screws or lag bolts 55 being driven through the building skin B behind the header and footer J-channels 20, 25 and into the horizontal header and sill framing members H, S. This will pinch the vertical flanges 21, 26 tightly into place in the window opening 40.

Figure 21:
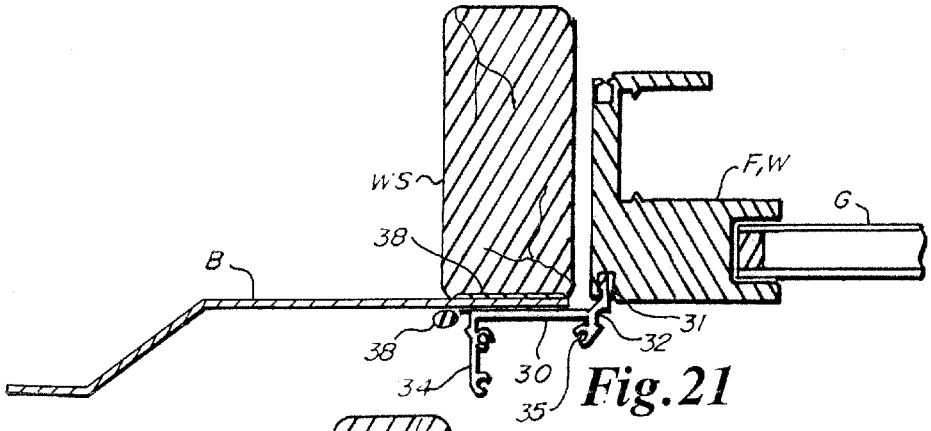
FIGS. 21-22 are cross-sections of the building wall and window frame at approximately the lines 21 and 22, respectively, of FIG. 16.
Figure 22:
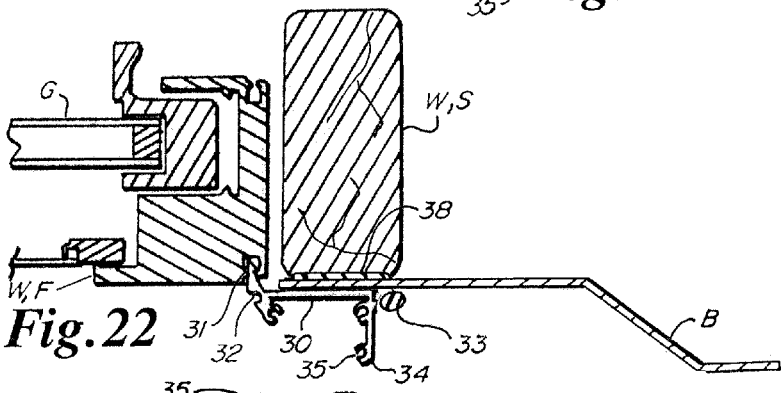
Figure 23:
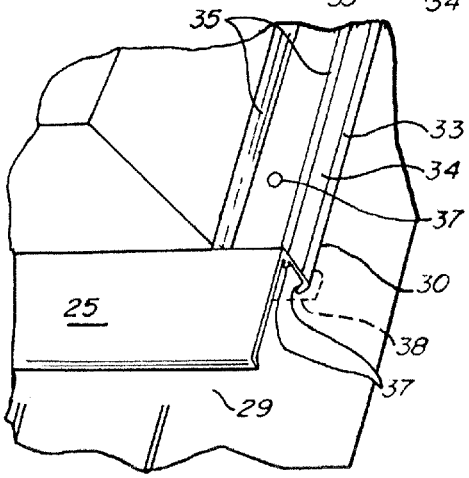
FIGS. 23-24 are perspective views of the vertical nailing fins and header J-channels.
Figure 24:
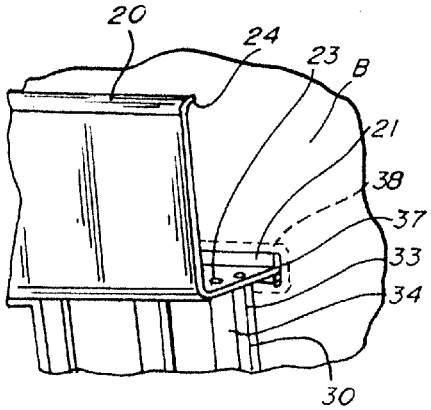

As shown in FIGS. 21 and 22, sealant 38 maybe applied along the exterior vertical edges of nailing fins 30. FIGS. 23 and 24 show sealant 38 is then applied at the horizontal ends of the frame header J-channel 20 where the vertical nailing fins 30 abut against the building skin B, thus sealing the corrugated building skin B to the header J-channel 20 at both ends and covering horizontal window cut extensions 45. A bead of sealant 38 may also be laid down where vertical flange 21 under laps the building skin B between J-channel 20 ends. Similarly, sealant is applied at the horizontal ends of the footer J-channel 25 where the vertical nailing fins 30 abut against the building skin B, thus sealing the corrugated building skin B to the sill or footer J-channel 25 at both ends and covering horizontal window cut extensions 45. A bead of sealant 38 may also be laid down where vertical flange 26 under laps the building skin B between footer J-channel 25 ends.

Figure 25:
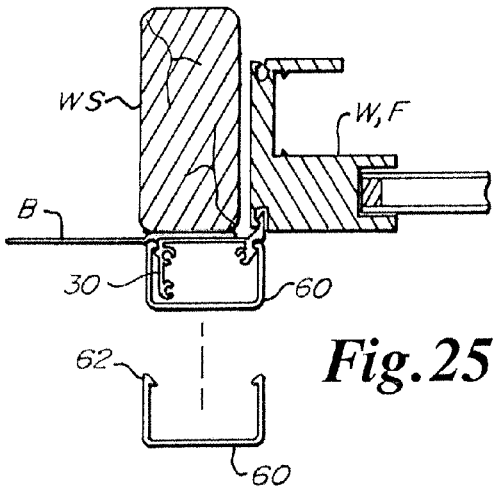
FIGS. 25-26 are cross-sections of the window frame of the present invention showing the installation of trim caps on the vertical nailing fins.
Figure 26:
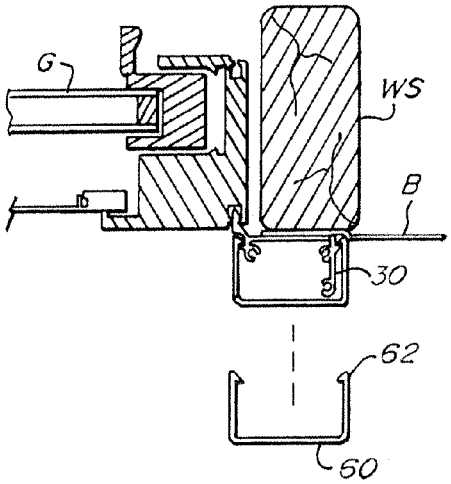
Figure 27:
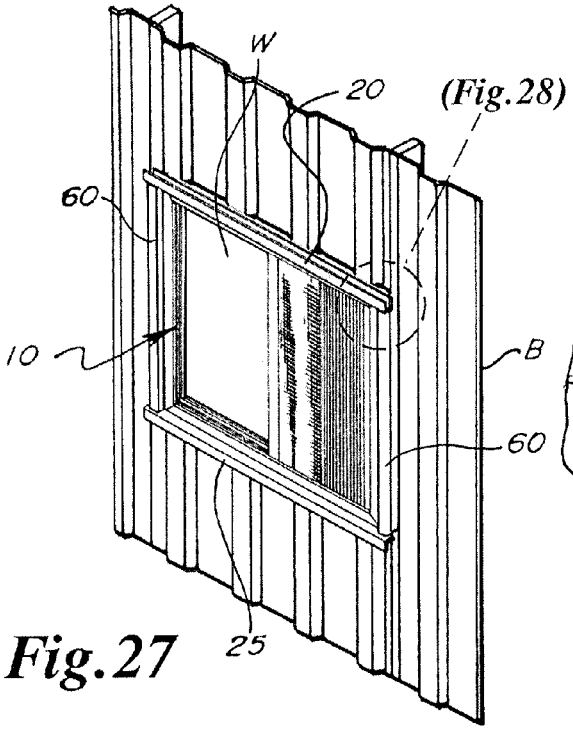
FIG. 27 is a perspective view of the window frame of the present invention after installation.
Figure 28:
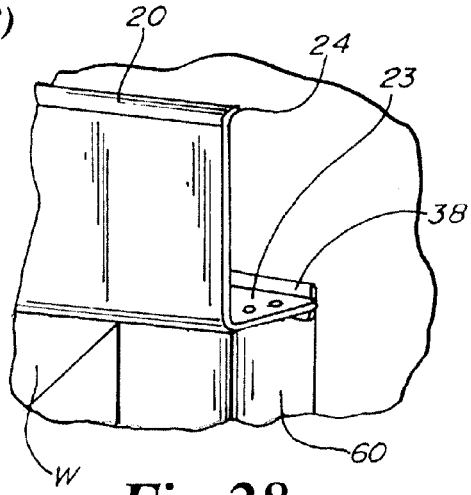
FIG. 28 is an enlarged view of the circled portion of FIG. 27 after complete installation.

The final step in installation, as shown in FIGS. 25-27, is to attach the vertical trim caps 60 to the vertical nailing fins 30, suitably by press-fitting them against the exterior of the vertical nailing fins 30. For this purpose, the vertical trim caps 60 may have barbs 62 which will interlock with trim cap detents 32 and trim cap barbs 33.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described below. The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A window frame exterior trim separate from and for a window with a frame having a top, bottom and sides, the window frame to be mounted in a corrugated metal building wall having a corrugated exterior skin, a vertically dimensioned cut window opening with internal adjacent vertical window studs and internal adjacent horizontal header and sill cross members, the window frame trim comprising:

(a) an upwardly directed exposed header J-channel separate from the window frame having a rearwardly directed attachment flange securable to the top of the window frame, an upwardly directed exposed water deflecting gutter channel and a vertical flange to be positioned between the building skin and header cross member;

(b) a downwardly directed exposed footer J-channel separate from the window frame having a rearwardly directed attachment flange securable to the bottom of the window frame, a vertical flange to be positioned between the building skin and footer cross member;

(c) a pair of vertical fins separate from the window frame each having a rearwardly directed attachment flange securable to one of the window frame sides; and (d) vertical fin trim caps to be fastened over and on top of the vertical fins.

2. The window frame trim of claim 1, wherein the fins each further comprise a trim cap outward extension generally 90° from the window.

3. The window frame trim of claim 2, wherein the fins and trim cap outward extensions have vertical screw channels for receiving screws through the J-channels to secure the J-channels to the fins.

4. A window frame exterior trim separate from and for a window with a frame having top, bottom and sides, the window frame to be mounted in a corrugated metal building wall having a corrugated exterior skin, a vertically dimensioned cut window opening with internal adjacent vertical window studs and internal adjacent horizontal header and sill cross members, the window frame trim comprising:

(a) an upwardly directed exposed header J-channel separate from the window frame having a rearwardly directed attachment flange securable to the top of the window frame, an upwardly directed exposed water deflecting gutter channel and a vertical flange to be positioned between the building skin and header cross member;

(b) a downwardly directed exposed footer J-channel separate from the window frame having a rearwardly directed attachment flange securable to the bottom of the window frame, a vertical flange to be positioned between the building skin and footer cross member;

(c) a pair of vertical fins separate from the window frame each having a rearwardly directed attachment flange securable to one of the window frame sides wherein the fins each further comprise a trim cap outward extension generally 90° from the window; and (d) vertical fin trim caps to be fastened over and on top of the vertical fins, wherein the window frame trim is dimensioned vertically greater than the vertically dimensioned cut window opening to secure the window trim behind the building skin.

5. The window frame trim of claim 4, wherein the fins and trim cap outward extensions have vertical screw channels for receiving screws through the J-channels to secure the J-channels to the fins.

6. A window frame exterior trim for a window with a top, bottom and sides with accessory grooves therearound, the window to be mounted in a corrugated metal building wall having a corrugated exterior skin, a vertically dimensioned cut window opening with internal adjacent vertical window studs and internal adjacent horizontal header and sill cross members, the window frame trim comprising:

(a) an upwardly directed exposed and open header J-channel having a rearwardly directed attachment flange with a rearwardly directed barb securable to the top accessory groove of the window, an upwardly directed exposed and open water deflecting gutter channel and a vertical flange adapted to be positioned between the building skin and header cross member;

(b) a downwardly directed exposed and open footer J-channel having a rearwardly directed attachment flange with a rearwardly directed barb securable to the bottom accessory groove of the window, a vertical flange adapted to be positioned between the building skin and footer cross member;

(c) a pair of vertical fins each having a rearwardly directed attachment flange with a rearwardly directed barb securable to one of the window sides accessory grooves; and (d) vertical fin trim caps to be fastened over and on top of the vertical fins.

7. The window frame trim of claim 6, wherein the fins each further comprise a trim cap outward extension generally 90° from the window.

8. The window frame trim of claim 7, wherein the fins and trim cap outward extensions have vertical screw channels for receiving screws through the J-channels to secure the J-channels to the fins.

9. A window frame exterior trim for a window with a top, bottom and sides with accessory grooves therearound, the window to be mounted in a corrugated metal building wall having a corrugated exterior skin, a vertically dimensioned cut window opening with internal adjacent vertical window studs and internal adjacent horizontal header and sill cross members, the window frame trim comprising:

(a) an upwardly directed exposed and open header J-channel having a rearwardly directed attachment flange with a rearwardly directed barb securable to the top accessory groove of the window, an upwardly directed exposed and open water deflecting gutter channel and a vertical flange adapted to be positioned between the building skin and header cross member;

(b) a downwardly directed exposed and open footer J-channel having a rearwardly directed attachment flange with a rearwardly directed barb securable to the bottom accessory groove of the window, a vertical flange adapted to be positioned between the building skin and footer cross member;

(c) a pair of vertical fins each having a rearwardly directed attachment flange with a rearwardly directed barb securable to one of the accessory grooves of the window sides wherein the fins each further comprise a trim cap outward extension generally 90° from the window; and (d) vertical fin trim caps to be fastened over and on top of the vertical fins, wherein the window frame trim is dimensioned vertically greater than the vertically dimensioned cut window opening to secure the window trim behind the building skin.

10. The window frame trim of claim 9, wherein the fins and trim cap outward extensions have vertical screw channels for receiving screws through the J-channels to secure the J-channels to the fins.

11. A method of installing a plastic extruded window frame exterior trim separate from but mounted onto a window frame having a top, a bottom and sides, the window frame to be installed in a corrugated metal building wall having a corrugated exterior skin, a vertically dimensioned cut window opening smaller than a vertical dimension of the window frame exterior trim, the window opening having internal adjacent vertical window studs and internal adjacent horizontal header and sill cross members, the method comprising:

(a) lifting the window frame with the exterior trim fastened therearound having an upwardly directed exposed header J-channel having a rearwardly directed attachment flange secured to the top of the window frame and an upwardly directed vertical flange to be positioned between the building skin and header cross member;

(b) lowering the window frame with the exterior trim fastened therearound having a downwardly directed exposed footer J-channel having a rearwardly directed attachment flange secured to the bottom of the window frame and a vertical flange to be positioned between the building skin and footer cross member thereby resting the window on the sill cross member;

(c) resting a pair of trim vertical fins of the exterior trim each having a rearwardly directed attachment flange secured to one of the window frame sides against the corrugate wall adjacent the window studs;

(d) securing with fasteners the vertical flanges behind the building skin; and (e) fastening vertical fin trim caps over the vertical fins.

* * * * *